US006044925A

United States Patent [19]

Sahyoun

[11] Patent Number: 6,044,925

[45] Date of Patent: Apr. 4, 2000

[54] PASSIVE SPEAKER

[76] Inventor: Joseph Yaacoub Sahyoun, 3031 Hopkins Ave., Redwood City, Calif. 94062-2835

[21] Appl. No.: 09/201,398

[22] Filed: Nov. 30, 1998

[51] Int. Cl.[7] ..... G10K 13/00

[52] U.S. Cl. ..... 181/157; 181/172; 181/171; 181/173; 381/431; 381/423; 381/398; 381/396

[58] Field of Search ..... 181/171, 172, 181/173, 176, 160, 151, 166, 144, 146, 148, 157; 381/423, 431, 425, 398, 396, 386, 337, 152, 150

[56] References Cited

U.S. PATENT DOCUMENTS

| | | | |
|---|---|---|---|
| 4,122,314 | 10/1978 | Matsuda et al. | 179/115.5 R |
| 4,198,550 | 4/1980 | Matsuda et al. | 179/181 F |
| 4,207,963 | 6/1980 | Klasco . | |
| 4,284,167 | 8/1981 | Kozlow et al. | 181/172 |
| 4,517,416 | 5/1985 | Goossens | 179/115.5 PS |
| 4,696,037 | 9/1987 | Fierens | 381/24 |
| 4,699,242 | 10/1987 | Ono | 181/170 |
| 4,714,133 | 12/1987 | Skaggs, Jr. | 181/160 |
| 5,701,359 | 12/1997 | Guenther et al. | 381/203 |
| 5,892,184 | 4/1999 | D'Hoogh | 181/171 |
| 5,929,393 | 7/1999 | Jeter, Jr. | 181/199 |

*Primary Examiner*—Robert E. Nappi
*Assistant Examiner*—Edgardo San Martin
*Attorney, Agent, or Firm*—Janis Biksa

[57] ABSTRACT

A passive radiator and method is disclosed which improves frequency response linearity and greatly reduces the possibility that wobble of a passive radiator which will occur without the displacement limitations of a spider containing speaker structure. Two substantially flat surfaced speaker diaphragms are tied together and supported by two sets of surrounds oriented in opposite directions to reduce the non-linearity in the surround spring rate and improve low frequency sound generation.

31 Claims, 5 Drawing Sheets

PASSIVE SPEAKER

FIELD OF THE INVENTION

This invention relates to loud speakers and in particular to the construction of passive radiators in closed loud speaker systems.

BACKGROUND OF THE INVENTION

A goal of sound reproduction equipment is to provide a life-like sound quality to the listener. Life-like sound quality is understood to be best achieved when a sound system including the speakers have a flat frequency response curve throughout the range of sound frequencies audible to the human ear, generally 20 to 20,000 Hz. A normal speaker cabinet has an electro magnetically driven speaker cone sealed to an opening in the wall of a sealed cabinet. This arrangement provides a drooping frequency response curve (e.g., 22 in the graph 20 of FIG. 1).

The graph 20 of FIG. 1 represents a comparison of sound level verses frequency (i.e., frequency response). The plot 22 shows the drooping response for a closed cabinet system. Over the years, in an effort to improve sound quality low, mid, and high range speakers have been placed in separate cabinets or compartments. Each of those separate cabinets or compartments could then be tuned by creating ports with or without tubes in them into the cabinet to improve the frequency response. At low frequencies, the use of open ports or open ports and tubes into the speaker cabinet becomes unmanageable because of the large amount of air mass that needs to be moved to provide adequate tuning. As an example, an ideal cabinet size to hear low frequencies might be larger than the room in which the listener was sitting.

In an effort to offset the effects of a rigid sealed cabinet and avoid the spatial requirements necessary when attempting to create ports or tube ports with speakers at low frequencies, passive radiators (generally configured like speakers, but without the electro mechanical driver) have been placed in a secondary opening of the walls of the speaker cavity to reduce the drop-off of the loudness at low frequencies. An example of the improvement in the frequency response when such a passive radiator is installed is shown as plot 24 in FIG. 1. An example of the improvement in the frequency response attributable to the installation of a passive radiator is shown by plot 26 in FIG. 2. Note that the drop in the frequency response curve at lower frequencies in plot 26 is very severe before the range of inaudible frequencies 28 is reached. In this configuration , AREA2, the area under the curve to the right of the peak above a minimum loudness level is larger than AREA1 which is the area under the curve to the left of the peak. This imbalance is indicative of the relative distortion that can be heard as the loudness of the passive radiator nosedives and falls below an audible loudness. The low frequency loudness and energy are not balanced with the high frequency loudness and energy. The area under the curves provide a measure of the imbalance.

Recent trends in the audio systems market have been leaning towards enhancing the bass or sub-woofer response of the audio reproduction systems, so that even if a sound is below the low limit of the range of audible sound, the sound level is high so that the listener, although he or she cannot "hear" the sound in their ears, they can "feel" the sound as parts of their body are hit by the low frequency waves. At low frequencies, a limitation of passive radiators has been that the low frequencies require large displacements of the moveable radiator elements. Such large displacements can exceed the available range of motion of moveable radiator elements. For example, in FIGS. 4, 5, and 6, a speaker spider 62 at its perimeter is attached to the back end of a speaker basket 50 while the spider's center edge (or core) it is attached to the back end of a speaker cone 58 or a diaphragm 68 to spider 72 connection element 74. In each pictured radiator, a central moveable element is suspended by a speaker "surround" (52, 70, 84) which acts as the flexible element between the stationary front of the speaker basket (50, 66, 80) and the speaker moveable element. Because the range of travel available from each spider (62, 72, 88) is less than the range of travel available from the surround (52, 70, 84), as the spider (62, 72, 88) reaches the limit of its travel and stops. The sudden stop in the movement of the spider due to its full extensions causes distortions in adjacent components as well as in the pressure gradients in the speaker chamber. These distortions can be heard as static and/or unnatural discontinuities in the sound. The ratio of the speaker basket back opening "B" (which supports the spider) to the speaker basket front opening "A" (which supports the surround) is approximately 0.5 (or 50%).

In the instance when a passive radiator constructed solely of a speaker cone is connected only as its peripheral rim to a annular support surface in the wall of a speaker, for example, as shown in the U.S. Pat. No. 4,207,963, to Klasco, a larger range of travel is available to accommodate large movable element displacements experienced at high volumes at low frequencies. However, the use of a surround around the perimeter of the top of the cone and the cone shape produces cone wobble which also distorts the sound. The object of the Klasco patent was to arrange active elements to reduce the wobble in the passive radiator.

In the instance where a lone speaker cone suspended in a cavity opening is used, the response of the passive radiator during low frequency cycles as the cone is forced outward and pulled inward can be non-linear as the flexible member (surround) holding the cone tends to have different non-linear force to displacement characteristics when being stretched outwardly as compared to when it is being stretched inwardly.

The limitations on travel as shown in the prior art described in FIGS. 4, 5 and 6 and the wobble of a passive radiator as discussed in the Klasco patent and such a configuration's non-linearity, highlight the shortcomings of the prior art passive radiators.

The spatial requirement of the prior art passive radiators is also a drawback. The prior art passive radiators are quite large and bulky and extend a large distance into any sealed cavity. This spatial requirement must be taken into account when designing features and companion speakers to fit into the sealed cavity.

SUMMARY OF THE INVENTION

An embodiment according to the invention overcomes the drawbacks of the prior art by providing a generally linear response by configuring two speaker surrounds opposite one another so that any non-linearities in the spring constant between an outward displacements versus an inward displacement are generally cancelled and a pseudo linear (symmetrical) spring constant is developed throughout the central range of travel of the passive radiator moveable elements. The center member is held at a neutral position as suspended by an inner elastic member and an outer elastic member when no force other than that of the inner elastic member and the outer elastic member is applied to the center member. When the center member is displaced in a first direction, which is approximately along a center axis of the opening in the frame, the elastic restoring force versus displacement curve evident when moving the center member assembly in the first direction from the neutral position is approximately symmetrical (and may be linear) with the elastic restoring force versus displacement curve evident when moving the center member assembly in a second direction from the neutral position, where the second direction is opposite the first direction. This arrangement provides a shallow depth large volume displacement passive radiator with a tuneable response (depending on the enclosure).

In an embodiment according to the invention an inner surround encircles and has an inner edge fixed to the perimeter of an inner center member which is generally a flat disk (flat plate) and may be a flat disk diaphragm. The arch of the surround between the inner edge and the perimeter edge of the inner surround extends in a first direction. An outer surround encircling and having an inner edge fixed to the perimeter of an outer center member is configured so that its arch extends in a second direction which is opposite the first direction. A connection member or mass is fixed to and between the inner center members and the outer center member causes the two to move together and in parallel. The connection member may be a specially sized mass to tune the passive radiator for resonance at a particular frequency. To evaluate parallelism the inner center member can be considered to have an inner member surface reference plane and the outer center member can be considered to have an outer member surface reference plane, such that the connection member keeps the inner member surface reference plane substantially parallel to the outer member surface reference plane.

Variations of embodiments according to the invention include using a ratio of the size of the inner center member to the outer center member or outer center member to the inner center member of between 0.8 and 1, the calculation of the ratio will be such that the ratio will always be 1 or less. Another embodiment provides the inner central member and outer central member to be connected and integral as one piece with an annular spring (elastic) member between the central integral inner and outer member core and the surrounding speaker frame opening. A cut out section of the wall of the speaker cabinet, for example can form the central diaphragm core, and the application of an elastic flowable substance that can be formed in place to form an elastic bond between the core and the surrounding support frame (usually a hole in the speaker cabinet) by using a formable elastic substance that can be formed in to a desired shape in flowable gel or liquid type state. Where the flowable substance sets up to have acceptable elastic qualities such as might be found when using a spider or surround of the current design in that location.

DETAILED DESCRIPTION

Figure 7:
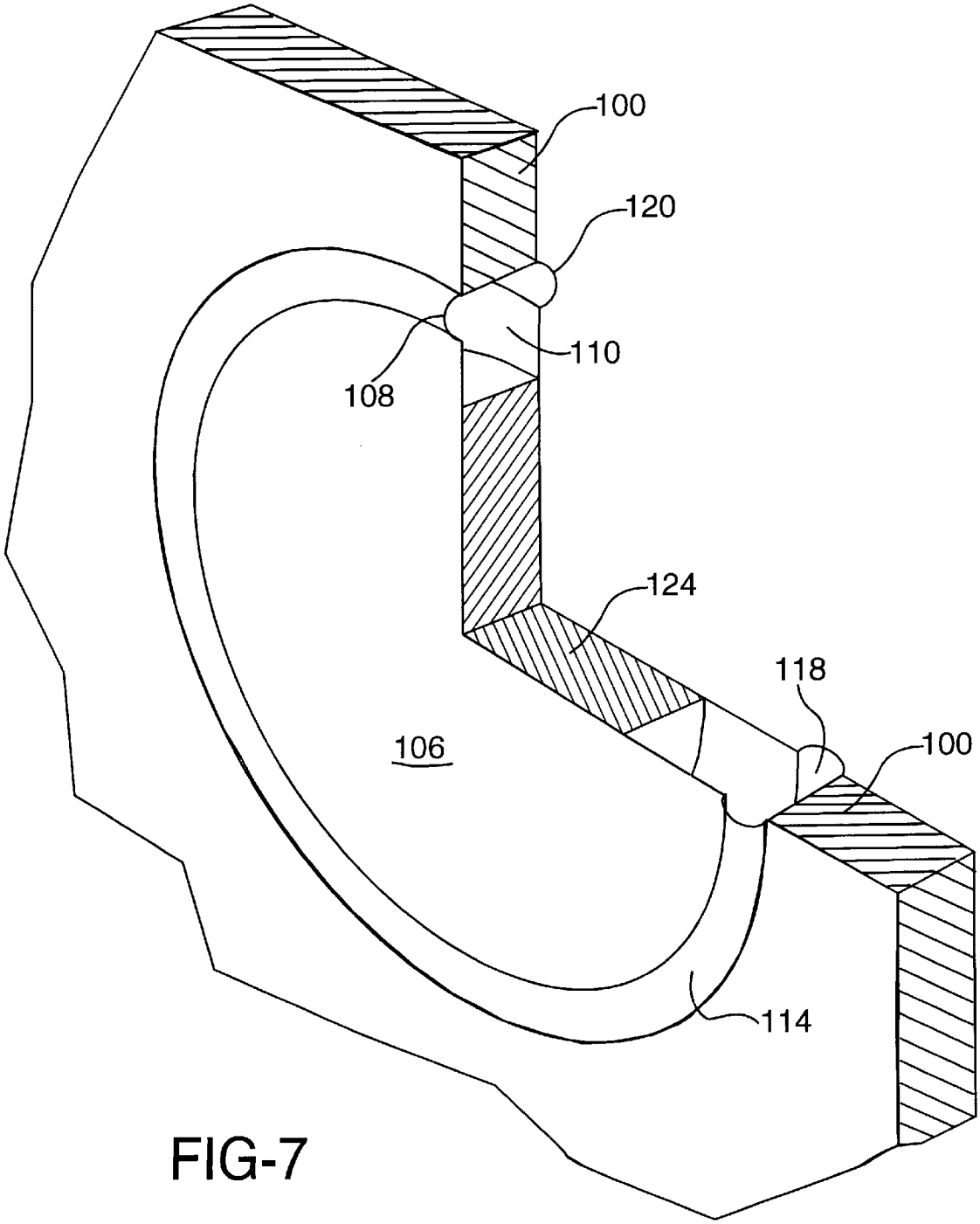
FIG. 7 shows an isometric cut away view of a configuration according to the invention.
Figure 8:
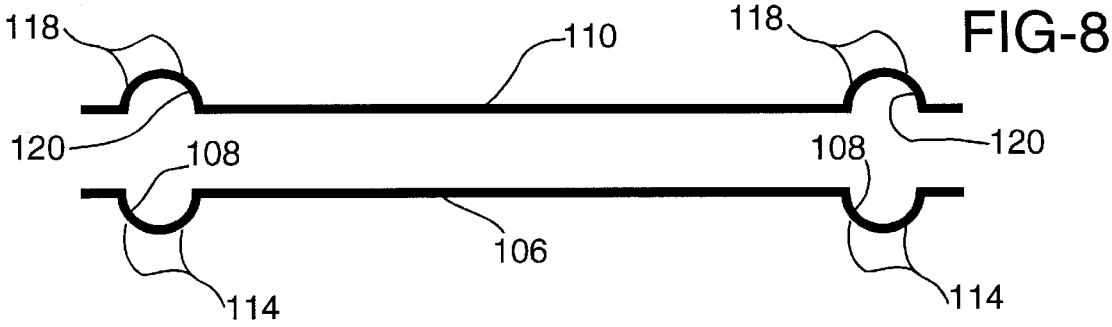
FIG. 8 shows a cross-sectional view of a diaphragm plate fixed to a surround which in turn is fixed to an external ring. Prior to their assembly into a configuration according to the present invention.

An embodiment according to the invention is shown is FIG. 7. A speaker box which acts as an integral speaker support ring 100 is a circular opening in a speaker box. To the speaker box at one edge of its wall is attached an inner surround 114 which has at its inner perimeter an inner diaphragm 106. At the outer wall of the speaker box 100, an outer surround 118 is attached with its inner perimeter fixed to an outer diaphragm 110. A connecting member (or mass) 124 is fixed between the two diaphragm 106, 110 so that the two move together in parallel as the sound pressure due to the frequencies in the sealed box causes the displacement of the two diaphragms simultaneous and in parallel. The inner and outer surrounds 114, 118 are configured so that the arch of 108 of the inner surround projects inwardly while the arch 120 of the outer surround 118 projects outwardly. In short, the center diaphragms 106, 110 and connection member 124 are supported only by the surrounds 114, 118 and the arches 108, 120 of the surrounds project in opposite directions.

In a normal speaker configuration where only one surround is used, e.g., at the perimeter of a speaker cone, there is a non-linear characteristic in the restoring force relative to displacement for a normal half circle type surround. The restoring force is the force that restores the speaker assembly to its neutral position for example during transportation and/or when the speaker is not in use. The non-linearity of the stressing of the inside surface of the arch versus the outside surface of the arch as the surround is stretch by the displacement of a center disk or speaker cone creates a small but detectable distortion. In such arrangements increased air pressure due to the sound waves does not move the diaphragm at the same rate when subject to similar pressure gradients, but rather the air starts to become compressed and generate reflected pulses as a result of the non-movement or slower movement of the diaphragm due to the different displacement rates. As the diaphragm in the passive radiator is exposed to air pressure due to sound volume, the use of two oppositely facing surrounds provide an effective compromise and an improvement over the use of the single surround by providing an approximately linear pressure to displacement relationship irrespective of whether a sound wave is positive (for example, causing the diaphragm to move out) or negative (for example, causing the diaphragm to move inward).

Figure 10:
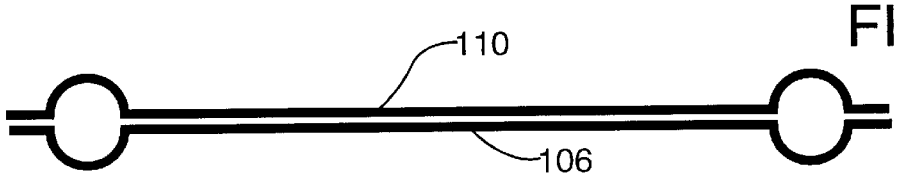
FIG. 10 shows a configuration according to the invention where the two diaphragm plates are fixed one to the other.
Figure 11:
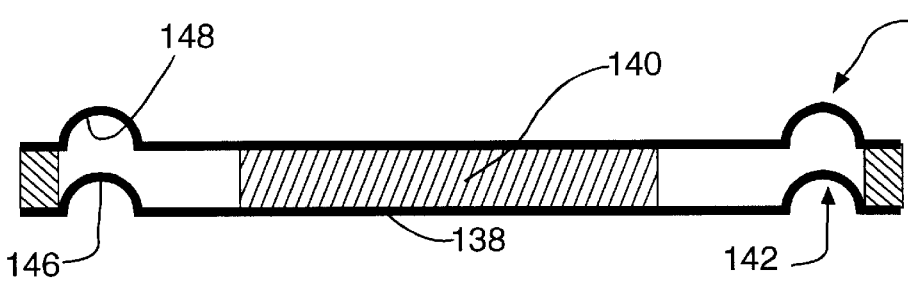
FIG. 11 shows an alternate configuration according to the invention where the arches of the speaker surround project in the same direction.

The use of two oppositely facing surrounds which are fixed to each other and with virtually no separation, for example, as shown in FIG. 10 provide a benefit over the prior art in that the spring constant in the full range of travel from the extreme negative through the neutral (or balanced condition) position to the extreme positive is much closer to linear than when using a single surround alone. However, in the configuration of FIG. 10, wobbling (defined as non-uniform displacement of the diaphragm) of the surround around its perimeter, for example, if a sound pressure wave were to come not perpendicularly into the diaphragm but at an acute angle from one side, then one side of the diaphragm could be preferentially displaced more than the other side at least monetarily this wobble could cause an undesired reflective wave and sound interference which is out of phase with the primary frequency. However, in instances where such a passive radiator is mounted directly opposite a single driver or a group of generally symmetrically arranged drivers, e.g., as in the Klasco patent discussed above, the configuration of FIG. 10 provides a noticeable if not distinct advantage over configurations where only a single surround using a speaker cone is used. Further, the flat surface of the diaphragm provides no transverse surface against which a transverse component of a pressure wave vector could cause lateral translation of the diaphragm as it could in a the prior art where the speaker cone provides a substantial laterally extending surface, which accentuates the any wobble that is experienced.

Figure 9:
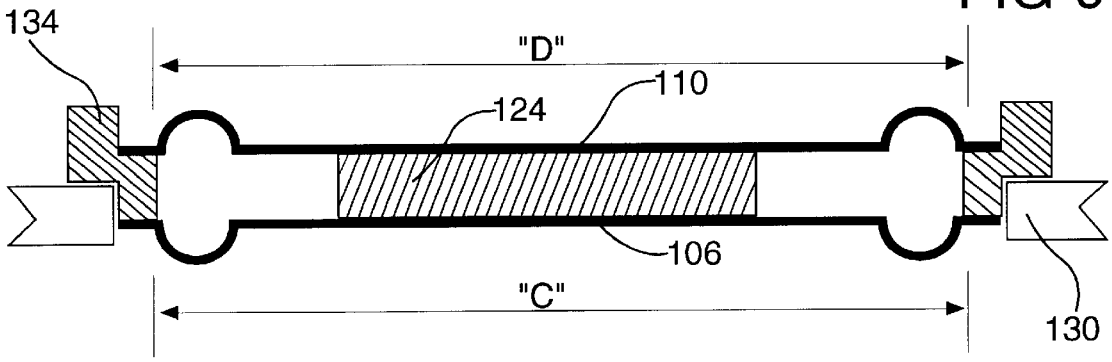
FIG. 9 shows a configuration according to the present invention fixed in a speaker wall.

A configuration according to the present invention has the additional advantage of eliminating the wobble problem by the use of a parallelogram-type parallel link arrangement where the two diaphragms 106, 110 each have their perimeters act as two ends of a fixed link of a parallelogram type linkage. A second set of fixed links are the corresponding inner and outer walls to which the outside perimeter of the surrounds 114, 118 are fixed. The moveable links connecting the two fixed links are the surrounds which extend between the perimeter of the central diaphragm 106, 110 and the inner perimeter of the outer ring for example, 134 in FIG. 9. Using this configuration will reduce any wobble by creating additional resistance to a wobbling effect due to the two surrounds being mounted in parallel at the end of what effectively amounts to an elastically extendible pivoting lever arm. Thus any configuration according to the invention for example as shown in FIG. 9, where a 45 degree sound wave coming into the central diaphragm would be resisted by both sets of surrounds such that predominately linear motion perpendicular to the face of the diaphragms would occur. The motion of the central diaphragm assembly while not completely limited to a linear back and forth motions is severely constrained to move easily only back and forth perpendicular to the diaphragms 106, 110 absent a strong transverse force vector. Similarly, the flat face of the diaphragm rigidly resists pressure pulses having force vectors which are parallel to its face, while it is very easily movable in a direction perpendicular to its face when impacted by sound pulses having force vectors with directional components perpendicular to the face of the diaphragm. In this way, an improved passive radiator can be constructed and used. While in the Figures shown, the ratio of the inner and outer diaphragm support openings are substantially equal, (i.e., they have a ratio of approximately 1), it is possible to construct passive radiators according to the invention where the ratio of the smaller diaphragm connection opening to the larger diaphragm connection opening is approximately 0.8 or greater (e.g., distance "C" on one side of the opening will be different than the distance "D" by a ratio of the smaller to the larger of 0.8).

The construction of the passive radiator is quite simple as shown in FIGS. 7, 8, 9, 10 and 11. The outside edge of the surrounds can be fixed directly to a sealed cavity or can be fixed to a surround support ring 134 which in turn is then fixed to a speaker enclosure wall 130. Some combination of elements to hold the outer ring and allow the center to move freely from its neutral position must be found.

An alternative configuration using a series of surrounds 142, 144 provides that the arches of 146, 148 such surround must extend in a single direction. This configuration while not optimum does provide the advantage over the prior art of eliminating or substantially eliminating the wobble problem referred to earlier. In a configuration as shown, the spring constants will be unequal and the non-linearity of the spring constant plot will be attenuated by the use of two surrounds whose spring constants add to exacerbate their distortion from linear.

Figure 12:
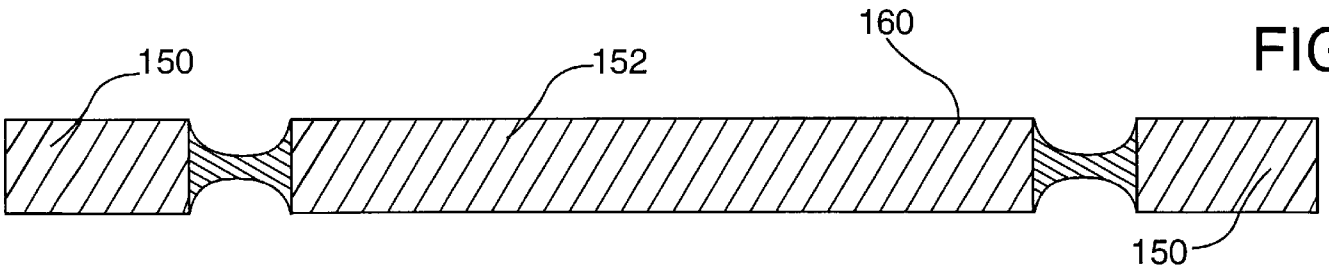
FIGS. 12, 13, and 14 show cross sectional views of several alternate embodiments according to the invention, where the wall of the speaker cabinet is used as the flat central core member of the passive radiator in a speaker system

FIG. 12 shows an alternate embodiment according to the invention, a speaker cabinet wall 150 , initially one piece, has circular slot routed into it thus separating a centerpiece 152 from the speaker cabinet wall 150. The round centerpiece 152 is centered in the opening of the cabinet wall and a wide contoured bead of filler material (e.g., silicon rubber) is run between the inside of the outer opening of the wall and the outside of the centerpiece 152. The cross sectional shape of the filler material is such that it retains an elastic character once cured. The cross section shown is commonly found in elastic seals between building joints where substantial movement is expected.

Figure 13:
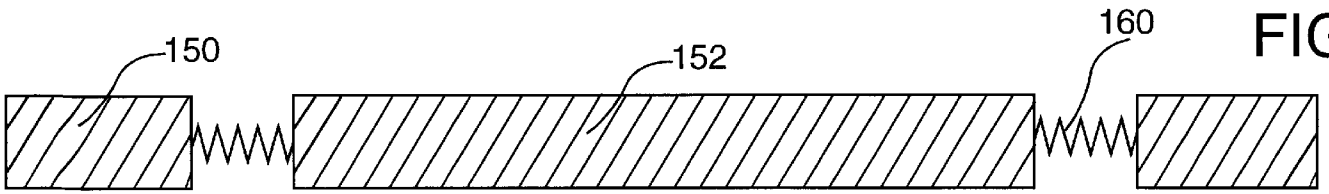

FIG. 13 pictures a spider type elastic member 160 having been placed between the centerpiece 152 and the speaker cabinet wall 150, as described for FIG. 12 above.

Figure 14:
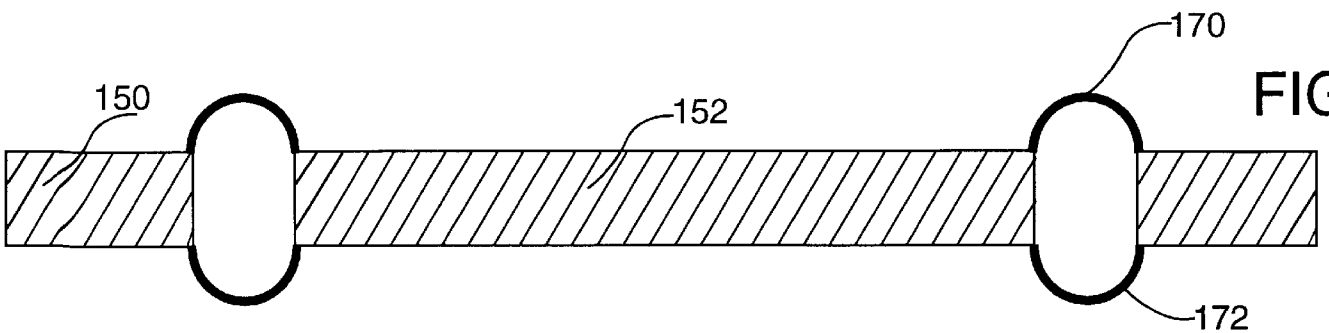

FIG. 14 pictures an alternate embodiment where a set of two surrounds 170, 172, provide the elastic connection between the speaker cabinet wall 150 and the centerpiece 152. While a round shape is preferred, the use of a less efficient shape is in accordance with the invention, for example a polygon or a compound curve shape may be used. A centerpiece thickness in excess of 0.25 inches , e.g., 0.5", 0.75", 1.0", 1.25", 1.5" etc., is preferable to help maintain a linear movement and reduce or eliminate any wobble that may occur.

Figure 1:
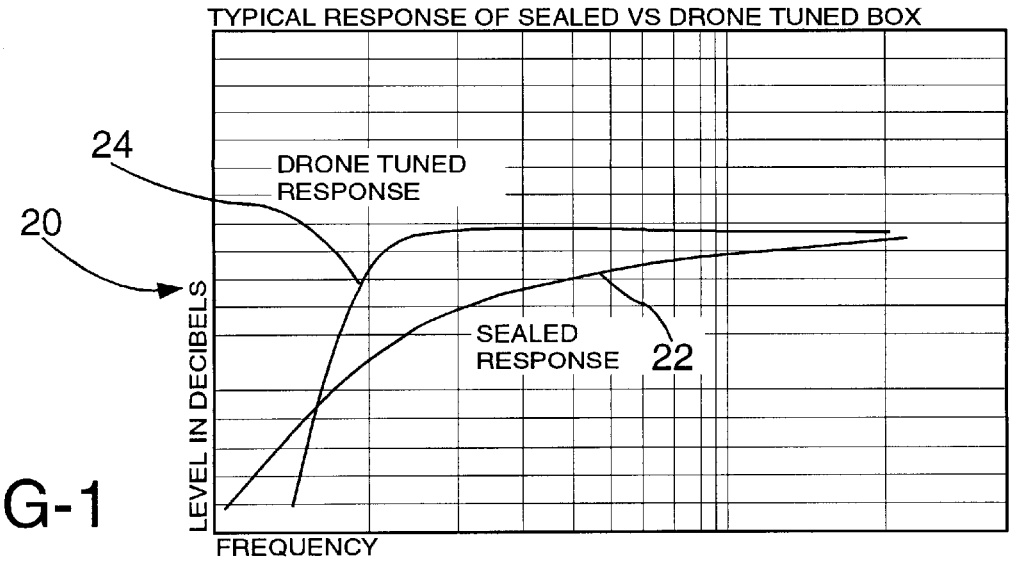
FIG. 1 is a plot of frequency response versus sound level in decibels showing the response of a sealed speaker box and a conventional droned tuned speaker box.
Figure 2:
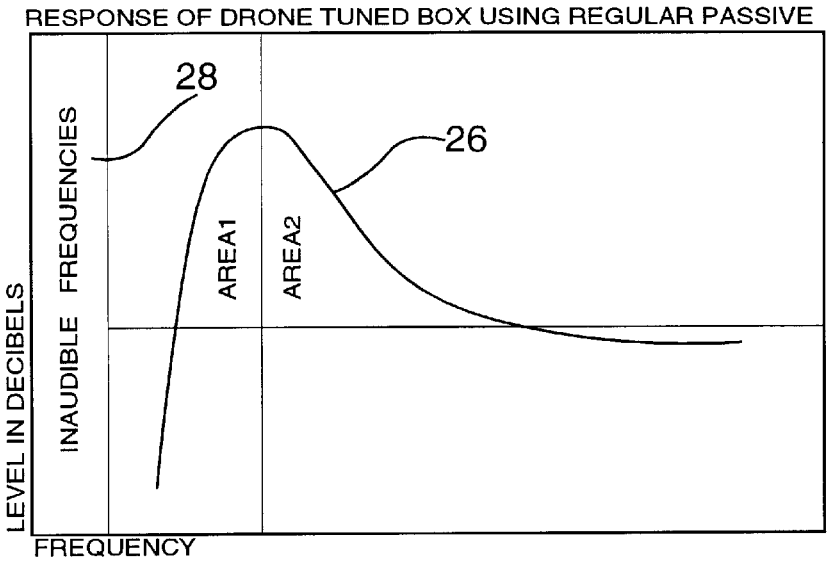
FIG. 2 is a frequency response graft showing the plot of the frequency response contribution from a passive radiator to the total tuned response in a speaker box system.
Figure 3:
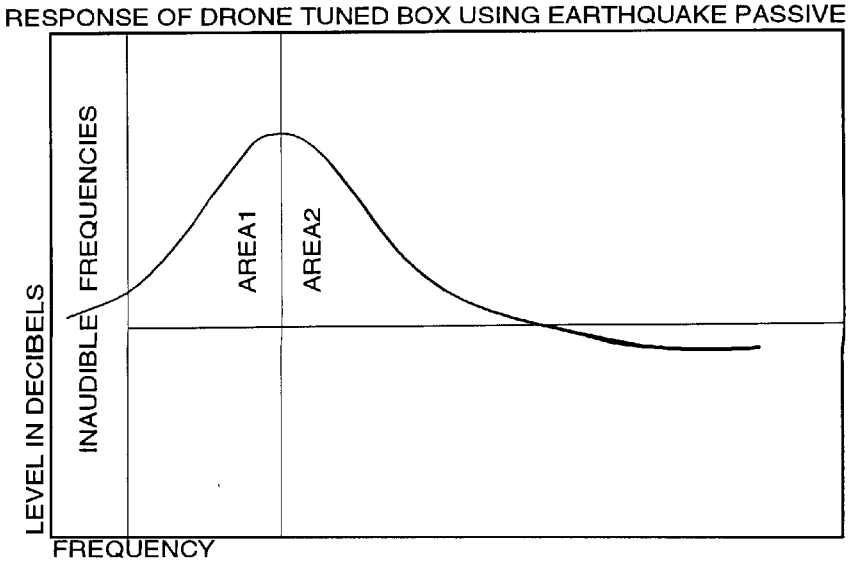
FIG. 3 is a frequency curve showing a plot of the frequency response using a device according to the present invention.
Figure 4:
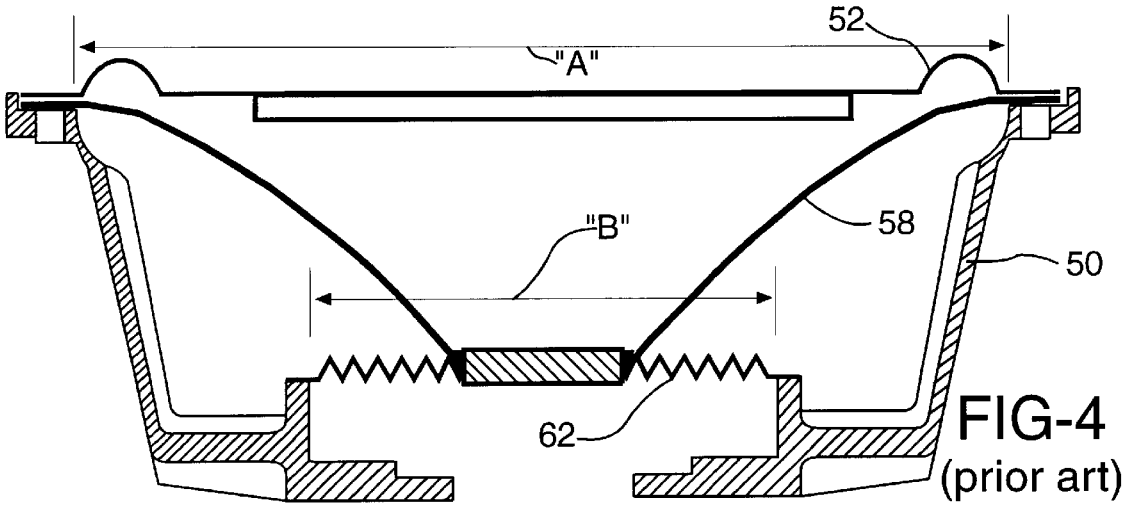
FIG-4 (prior art)
FIG. 4 is a cross sectional view of the prior art passive radiator supporting masses at both the base of the cone and on a diaphragm spanning the large opening of the cone at the base of the speaker.
Figure 5:
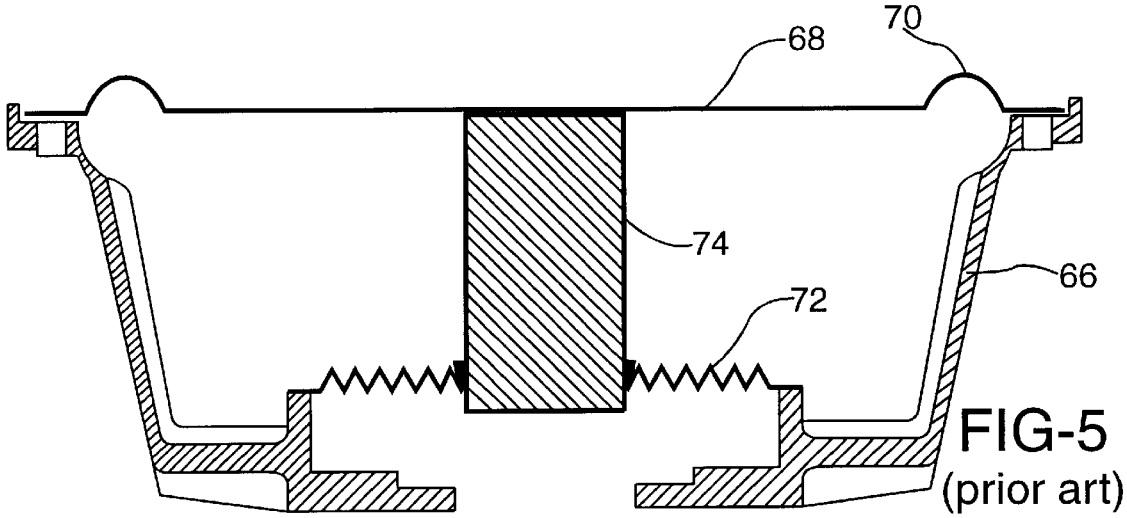
FIG-5 (prior art)
FIG. 5 is a cross-sectional view of a prior art passive radiator showing a moveable diaphragm connected to a speaker surround at the mouth of the speaker baskets to a speaker spider at the back of the speaker basket.
Figure 6:
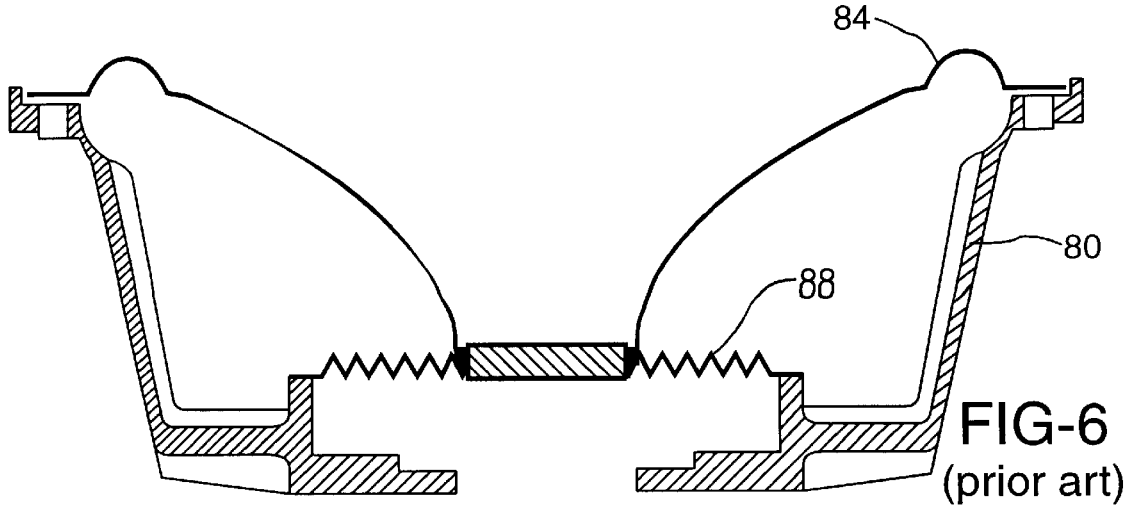
FIG-6 (prior art)
FIG. 6 shows a cross-section of a prior art passive radiator showing a speaker cone with a tuning mask at its base connected to the spider to the speaker basket at its narrow end connected through a surround to its wide end of the speaker basket.

A review of the plot as shown in FIG. 3 shows that the frequency response of a tuned passive radiator according to the invention extends the usable frequency range from the low audible to the inaudible range of frequencies. All audible frequencies can be heard and the inaudible frequencies for example, an earth shake or pounding can be generated by such speakers so that the user can "feel" the vibration as the user's surroundings susceptible to such low frequency waves start to vibrate. The use of such speaker enhancing device is very attractive to sophisticated users as well as the general public in viewing many action movies that feature such low frequency sounds.

While the invention has been described with regard to specific embodiments, those skilled in the art will recognize that changes can be made in form and detail without departing from the spirit and scope of the invention.

I claim:

1. A passive radiator comprising:

an inner surround encircling and having an inner edge fixed to the perimeter of an inner center member, an arch of said inner surround extending in a first direction;

an outer surround encircling and having an inner edge fixed to the perimeter of an outer center member, an arch of said outer surround extending in a second direction, opposite said first direction;

where the inner center member is fixed to and substantially integral with said outer center member.

2. The passive radiator as in claim 1, wherein the inner center member is fixed to and substantially integral with said outer center member through a connection member fixed to and between said inner center member and said outer center member.

3. The passive radiator as in claim 2, wherein said connection member has a mass that provides acoustic resonance of said passive radiator at a selected frequency.

4. The passive radiator as in claim 2, wherein said inner center member has an inner member surface reference plane and said outer center member has an outer member surface reference plane;

wherein said connection member is fixed to the inner and the outer center member so as to keep said inner member surface reference plane substantially parallel to said outer member surface reference plane.

5. The passive radiator as in claim 4, wherein said connection member has a mass that provides acoustic resonance of said passive radiator at a selected frequency.

6. The passive radiator as in claim 2, wherein the inner center member and said outer center member each are a substantially flat plate.

7. The passive radiator as in claim 6, wherein said inner center member has an inner member surface reference plane and said outer center member has an outer member surface reference plane;

wherein said connection member is fixed to the inner and the outer center member so as to keep said inner member surface reference plane substantially parallel to said outer member surface reference plane.

8. The passive radiator as in claim 6, wherein said connection member has a mass that provides acoustic resonance of aid passive radiator at a selected frequency.

9. A passive radiator comprising:

an inner elastic member encircling and having an edge fixed to the perimeter of an inner center member and an outer perimeter fixed to a first location of an opening in a frame of said passive radiator;

an outer elastic member encircling and having an inner edge fixed to the perimeter of an outer center member and an outer perimeter fixed to a second location of said opening of said frame of said passive radiator;

where the inner center member is fixed to and moves with said outer center member as a center member assembly;

wherein said center member assembly is held at a neutral position as suspended by said inner elastic member and said outer elastic member when no force other than that of said inner elastic member and said outer elastic member is applied to said center member assembly;

wherein when said center member assembly is displaced in a first direction, which is approximately along a center axis of said opening in said frame, the elastic restoring force versus displacement curve evident when moving said center member assembly in said first direction from said neutral position is approximately symmetrical with the elastic restoring force versus displacement curve evident when moving said center member assembly in a second direction from said neutral position, where said second direction is opposite said first direction.

10. The passive radiator as in claim 9, wherein when said center member assembly is displaced in a first direction, which is approximately along a center axis of said opening in said frame, the elastic restoring force versus displacement curve evident when moving said center member assembly in said first direction from said neutral position is approximately linear with the elastic restoring force versus displacement curve evident when moving said center member assembly in a second direction from said neutral position, where said second direction is opposite said first direction.

11. The passive radiator as in claim 9, wherein the ratio of the size of the smaller of the first location of said opening and second location of said opening to the larger of the first location of said opening and second location of said opening is 0.8 or greater.

12. The passive radiator as in claim 9, wherein the size of said inner elastic member is approximately the same as the size of said outer elastic member.

13. The passive radiator as in claim 9, wherein a closest distance between said inner elastic member and said outer elastic member is approximately 1 inch (2.54 cm).

14. A passive radiator comprising:

a wall of a speaker cabinet having a passive radiator opening therein;

a centerpiece disposed within said passive radiator opening; and an annular elastic member disposed between an inner perimeter of said passive radiator opening and an outer perimeter of said centerpiece.

15. The passive radiator as in claim 14, wherein said annular elastic member is a spider disposed in the annular space between an inner perimeter of said passive radiator opening and an outer perimeter of said centerpiece.

16. The passive radiator as in claim 14, wherein said annular elastic member is constructed from one or more beads of a flowable elastic material formed in the annular space between an inner perimeter of said passive radiator opening and an outer perimeter of said centerpiece which has hardened to form a static elastic material.

17. The passive radiator as in claim 16, wherein said flowable elastic material is a silicone type rubber.

18. The passive radiator as in claim 14, wherein said annular elastic member is a set of at least two surrounds disposed in and connecting across the annular space between an inner perimeter of said passive radiator opening and an outer perimeter of said centerpiece, where an arch of a first of said set of at least two surrounds extends in a first direction, while an arch of a second of said set of at least two surrounds extends in a second direction generally opposite said first direction.

19. The method for providing a passive radiator as in claim 18, wherein the step of establishing an elastic connection provides an inner surround and an outer surround such that when said centerpiece is displaced in a first direction, which is approximately along a center axis of said speaker opening, the elastic restoring force versus displacement curve evident when moving said centerpiece in said first direction from said neutral position is approximately linear with the elastic restoring force versus displacement curve evident when moving said centerpiece in a second direction from said neutral position, where said second direction is opposite said first direction.

20. The passive radiator as in claim 14, wherein said centerpiece is a flat plate.

21. The passive radiator as in claim 20, wherein said centerpiece is constructed of the same material as the wall of the speaker cabinet.

22. A method for providing a passive radiator comprising the steps of:

providing a speaker opening in a wall of a speaker system;

configuring a centerpiece to fit in said speaker opening with an annular gap between the perimeter of the centerpiece and the inner edge of the opening; and establishing an elastic connection across said annular gap using an elastic member which consists of an inner surround connecting a first side of said centerpiece and a first side of said wall, where said inner surround has an arch extending in a first direction and an outer surround connecting a second side of said centerpiece and a second side of said wall, where said outer surround has an arch extending in a second direction opposite said first direction.

23. The method for providing a passive radiator as in claim 22, wherein the step of configuring the centerpiece include providing a substantially flat surface facing the inside of the speaker cabinet.

24. The method for providing a passive radiator as in claim 22, wherein the step of configuring the centerpiece includes establishing a thickness of said centerpiece between said first side and said second side such that the thickness is at least 0.25 inches.

25. The method for providing a passive radiator as in claim 24, wherein the step of configuring the centerpiece includes establishing a mass of the centerpiece to provide resonance of the passive radiator at a particular frequency.

26. The method for providing a passive radiator as in claim 24, wherein the step of configuring the centerpiece includes establishing a thickness of said centerpiece between said first side and said second side such that the thickness is approximately one inch.

27. The method for providing a passive radiator as in claim 24, wherein the step of establishing an elastic connection provides an inner surround and an outer surround such that when said centerpiece is displaced in a first direction, which is approximately along a center axis of said speaker opening, the elastic restoring force versus displacement curve evident when moving said centerpiece in said first direction from said neutral position is approximately symmetrical with the elastic restoring force versus displacement curve evident when moving said centerpiece in a second direction from said neutral position, where said second direction is opposite said first direction.

28. A shallow depth large volume displacement passive radiator comprising:

an approximately flat and stiff centerpiece;

a frame surrounding said centerpiece;

an inner surround having an annular diameter and connecting a perimeter of said first side of said centerpiece to a first position on said frame;

an outer surround having approximately said annular diameter and connecting a perimeter of said second side of said centerpiece to a second position on said frame;

wherein a first distance between said first side of said centerpiece to a second side of said centerpiece is approximately the same and a second distance between said first position and said second position;

wherein said first distance and said second distance are 0.25 inches or greater.

29. The shallow depth large volume displacement passive radiator as in claim 28, wherein said first distance and said second distance are approximately one inch.

30. The shallow depth large volume displacement passive radiator as in claim 28, wherein the mass of said centerpiece is selected to provide resonance at a particular frequency in a particular size enclosure.

31. The shallow depth large volume displacement passive radiator as in claim 28, wherein said first side of said center piece is approximately flat and approximately parallel to said second side of said center piece which is also approximately flat.

* * * * *